US005775935A

United States Patent [19]

Barna

[11] Patent Number: 5,775,935

[45] Date of Patent: Jul. 7, 1998

[54] SYSTEM AND METHOD FOR CONNECTING COLOR CODED CABLES TO A DEVICE

[75] Inventor: Joseph A. Barna, Marietta, Ga.

[73] Assignee: Computer Data Exchange, Inc., Marietta, Ga.

[21] Appl. No.: 769,456

[22] Filed: Dec. 18, 1996

[51] Int. Cl.[6] ..... H01R 9/22

[52] U.S. Cl. ..... 439/488; 439/491; 174/112

[58] Field of Search ..... 439/488–491; 174/112; 40/316

[56] References Cited

U.S. PATENT DOCUMENTS

| | | | |
|---|---|---|---|
| 2,892,175 | 6/1959 | Frey | 439/488 |
| 2,945,204 | 7/1960 | Berger | 439/491 |
| 3,123,663 | 3/1964 | Muldoon | 174/112 |
| 4,781,619 | 11/1988 | Ikeda | 439/491 |
| 4,784,614 | 11/1988 | Sadigh-Behzadi | 439/488 |
| 4,820,193 | 4/1989 | Noorily | 439/488 |
| 5,114,363 | 5/1992 | Mitra | 439/491 |
| 5,410,828 | 5/1995 | Millet et al. | 40/316 |
| 5,449,302 | 9/1995 | Yarbrough et al. | 439/680 |
| 5,533,917 | 7/1996 | Schmitz | 439/894 |
| 5,613,874 | 3/1997 | Orlando et al. | 439/491 |

FOREIGN PATENT DOCUMENTS 6338364 12/1994 Japan .

*Primary Examiner*—Hien Vu

[57] ABSTRACT

The present invention is a color coded system for associating each of a plurality of individual electrical connection ports of a transactional terminal with a particular cable designated for connection with a specific one of the ports. The system includes a device that has a plurality of electrical connection ports for receiving cables. The device has a recessed portion extending around the electrical connection ports. The recessed portion has a rim defining the boundary of the recess. The system also includes a color coded alignment strip that has a surface of colors arranged in ordered positions on the strip. The colors of the surface correspond to color coded cables. The color coded alignment strip is positioned and is aligned in the recess in a position that aligns the colors with the electrical connection ports that are to receive the color coded cables of the corresponding colors aligned with the electrical connection ports. The color coded alignment strip fits in the recess such that the surface of the alignment strip is positioned at or below the same level as the rim of the recess.

10 Claims, 2 Drawing Sheets

SYSTEM AND METHOD FOR CONNECTING COLOR CODED CABLES TO A DEVICE

FIELD OF THE INVENTION

The present invention relates to the field of cable connection systems, and particularly, relates to the field of cable connection systems for transactional terminals.

Background of the Invention

Many computing or electronic data processing machines are designed to be interconnected with other devices/systems or are designed to be connected with certain peripheral devices. While these base units may be complex machines, the manner in which these devices are connected to other devices can be relatively simple.

Because connecting computing devices or machines with other devices can be a relatively simple task, the task of connecting computing devices with other devices or peripherals is often the responsibility of the worker or user of the computing machine, not a technician. Often an assortment of cables are provided for interconnecting multiple devices of a system. Although the worker or user may be familiar with operating the computing device, the worker or user may be unfamiliar with interconnecting particular computing devices using the provided cables.

Recognizing the need for systems or processes to aid a user to connect cables to the appropriate ports on devices, many systems have been devised to assist a user. Such systems often include color coding or identifying the port at which a cable is to be connected by placing a color identifier that is the same as the cable over or near the port that is to receive the cable. For example, the following patents have addressed the problem: U.S. Pat. Nos. 2,892,175; 2,945,204; 4,820,193; and 5,114,363; and Japanese patent no. 06338364. The color coding systems of many of the devices discussed in these patents can not be directly applied to the certain transaction terminals due to physical differences, cost of application, or quality control issues.

For example, U.S. Pat. No. 2,945,204 to Berger ("Berger") relates to a designation strip that may be mounted adjacent to a plurality of terminals for receiving color coded wires. The designation strip contains selected portions of the insulating material of the color coded wires. The portions of the color coded wires are ordered on the designation strips according to the terminals designated to receive a specific color coded wire. A transparent cover is placed over the designation strip to secure the portions of the color coded insulation to the designation strip. The designation strip has apertures for mounting the designation strip on the terminal device. While the Berger system relates to a color coded system for connecting cables, the Berger system is not suited for implementation with certain terminal devices. The designation strip of the Berger system is mounted to the apparatus using some type mounting mechanism connected to the apparatus through appatures. Such mounting mechanisms are apparantly screws or some other similar mechanisms. Many devices are not suited to have designation strips mounted in the manner contemplated by Berger.

U.S. Pat. No. 5,114,363 to Mitra ("Mitra") relates to a color coding system for an electrical connecting device. Mitra includes color coded spherical objects that are snapped into openings adjacent to selected conductor connectors. The color coded spherical objects correspond to the color of the conductor that should be placed in the adjacent conductor connector. While the Mitra system relates to a color coded system for connecting cables, the Mitra system is not suited for implementation with certain terminal devices. The spherical objects of the Mitra system are mounted by snapping the spherical objects into openings on the electrical connecting device. This mounting mechanism is not suited for many transaction terminals, such as credit card terminals.

While color coding of cables and receptacles to facilitate correct coupling is known, such a system has not previously been implemented with credit card terminals or similar terminals and related equipment. Failure to provide such an aid appears to arise from reliance on the uniqueness of the receptacles for the cables which couple to credit card terminals. That is, because most receptacles on a credit card terminal have different pin configurations so that only one type of cable may be inserted in the receptacle, there has been no perception of a need for a color coding system. However, customer support service has repeatedly seen a problem where customers do not understand the matching pin configuration concept and require a simpler method for matching plugs to receptacles.

Thus, there is a need in the art for a method and system for connecting color coded cables to transaction terminals and particularly credit card transaction terminals.

SUMMARY OF THE INVENTION

Generally described, the present invention is a color coded system for associating each of a plurality of individual electrical connection ports of a transactional terminal with a particular cable designated for connection with a specific one of the ports.

More particularly, the present invention relates to a device that has a plurality of electrical connection ports for receiving cables. The device has a recessed portion extending around the electrical connection ports. The recessed portion has a rim defining the boundary of the recess. The system also includes a color coded alignment strip that has a surface of colors arranged in ordered positions on the strip. The colors of the surface correspond to color coded cables. The color coded alignment strip is positioned and is aligned in the recess in a position that aligns the colors with the electrical connection ports that are to receive the color coded cables of the corresponding colors aligned with the electrical connection ports. The color coded alignment strip fits in the recess such that the surface of the alignment strip is positioned at or below the same level as the rim of the recess.

Additionally, the colors aligned with the electrical connection ports may extend around the electrical connection ports. These colors may further extend entirely around the electrical connection ports.

In another embodiment of the system of the present invention, a device has a plurality of electrical connection ports for receiving cables. The device has a rim portion extending around the electrical connection ports. The system of this embodiment also includes a color coded alignment strip that has a surface of colors arranged in ordered positions on the strip. The colors of the strip correspond to color coded cables. The color coded alignment strip is positioned and is aligned in the rim in a position that aligns the colors with the electrical connection ports that are to receive the color coded cables of the corresponding colors aligned with the electrical connection ports. The color coded alignment strip fits within the rim and the color coded alignment strip has a surface that contacts the device within the rim. The rim extends above the edge of the surface of the color coded alignment strip that contacts the device.

In another embodiment of the present invention a device has a plurality of electrical connection ports for receiving cables. The device has a rim portion that extends around the electrical connection ports. The rim has an upper level extending away from the surface of the device. The system also includes a plurality of color coded items. The color coded items correspond to color coded cables. The color coded items are arranged in ordered positions and are aligned in the rim in positions that align the color coded items with the electrical connection ports that are to receive the color coded cables of the corresponding color as the color coded items aligned with the electrical connection ports. The color coded items fit in the rim. The color coded items fit with in rim such that the surfaces of the color coded items that are visible after the color coded items are positioned in the recess being positioned at or below the same level as the upper level of the rim.

Thus, it is an object of the present invention to provide a color coded cable connection system for transactional terminals to aid in connecting cables to the terminal.

It is also an object of the present invention to provide a cable connection system that secure a color coded alignment strip on the terminal in a manner that prevents inadvertent removal of the alignment strip from the terminal.

These and other objects of the present invention will become apparent to those of ordinary skill in the art when viewed in connection with the following description and drawings.

DETAILED DESCRIPTION OF THE INVENTION

Figure 1:
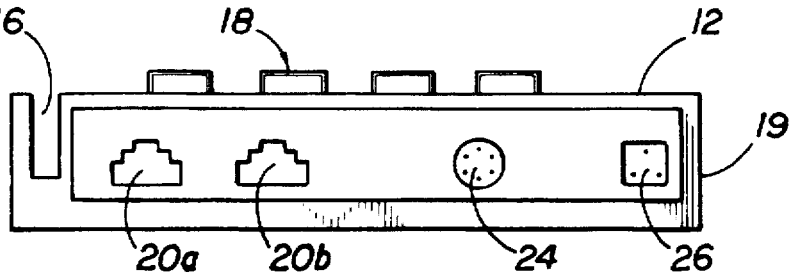
FIG. 1 is a diagram of a recess in a credit card terminal used for protecting a color coded alignment strip constructed according to the present invention.

Referring to the Figs. in which like numerals represent like parts throughout the several views, various embodiments of the present invention are illustrated. The present invention relates to a color coding system that facilitates the connection of color coded electrical cables to a transactions terminal and related equipment. The system of the present invention may include a color coded template that is placed in an area proximate to electrical connection ports on the transactions terminal. A color coded area of the template corresponds to a color of a connection cable that is to be placed in the port that is near the color of the template that matches the cable. The case of the terminal has a rim area defined for placement of the template. The rim area protects the edges of the template when the template is placed within the rim area. The cables may have the insulation portions of the cables entirely colored or the cables may have tags or identifiers that correspond to the colors on the template. The system of the present invention enables the user to simply match the colors of the cables with the corresponding template color near the terminal connection port.

Referring to FIGS. 1, 2*a*–2*d*, and 3, the system of the present invention is described. The cable connection system 10 (FIG. 3) facilitates the connection of electrical cables to a transaction terminal and related equipment. The transaction terminal illustrated is a credit card terminal 12. The credit card terminal 12 enables a retailer to bill or charge a customer using the customer's credit card or credit card number. The credit card terminal 12 has the keypad 18 to aid in inputting information related to a customer's credit card. Also, information related to the customer's credit card may be obtained by sliding the credit card through a slot 16 that has a magnetic reader for reading the information associated with a magnetic strip on the customer's credit card. The credit card terminal 12 has a credit card terminal housing 19 enclosing the electronics of the credit card terminal 12. In order for the electronics of the credit card terminal 12 to be connected to other devices, external connection ports are provided on the credit card terminal 12 for communication with other devices by connection cables.

The credit card terminal 12 has telephone jack connection ports 20*a* and 20*b*, a printer connection port 24, and a power cord connection port 26. The telephone jack connection port 20*a* or 20*b* enables the credit card terminal 12 to communicate over the telephone lines with external communication devices. The printer connection port 24 enables the credit card terminal 12 to be connected to a printer. The printer connection port 24 and a corresponding printer cable have a specific type of connection or port that is different from the telephone connection port 20*a* or 20*b*. Similarly, the power cord connection port 26 is different than a telephone jack connection ports 20*a* and 20*b*, and the printer connection port 24. It should be appreciated that the connection ports herein may be of the same type and that the ports may vary from terminal to terminal.

While providing ports of different shapes or sizes helps to facilitate the connection of a particular cable with a corresponding design, certain users who are not familiar with the connections of electrical cables to electrical devices make one or a few attempts to plug a cable into a particular port that is not designed for the port before giving up on making the necessary connection. When the user cannot make the necessary connection of cable to port, the user often calls the customer service department of manufacturer of the terminal device to receive instructions. The present invention helps to alleviate this problem by providing a color coded assignment strip 40 (FIG. 2*a*) that corresponds to color coded cables.

The color coded cables 52*a*–52*c* and corresponding color coded sections 44*a*–44*c* of the color coded alignment strip 40 are illustrated. The telephone cable 52*a* has a telephone jack 51 for connection to the telephone jack connection port 20*a*. The color of the telephone cable 52*a* is the same color as the color 44*a* of the color coded alignment strip 40. The color 44*a* is represented by diagonal lines on section 45*a* of the color coded alignment strip 40. As used herein, the specific symbols or patterns of various cables, objects, items, or sections represent colors. Similarly shaded cables, items, objects, or sections indicate that the cables, objects, items, or sections represent the same color. It should be appreciated that sections 45 of the color coded alignment strip 40 may be separate items used to coordinate the ports with specific colors. While the present invention describes the coordination of cables, items, sections or objects by color, it is understood that the various shadings can themselves represent a system for coordinating the cables with connections as described in connection with the present invention. The connection cable 52*b* represents a printer cable with a printer connector 53 for connection in the printer connection port 24. The color of the printer connection cable 52*b* corresponds with the color 44*b* of the section 45*b* of the color coded alignment strip 40. A power cord connection cable 52*c* has a power cord connection 55 for connecting the power cord connection port 26. The color of the power cord connection cable 52*c* corresponds with the color 44*c* of the section 45*c* of the color coded alignment strip 40.

Figure 2A:
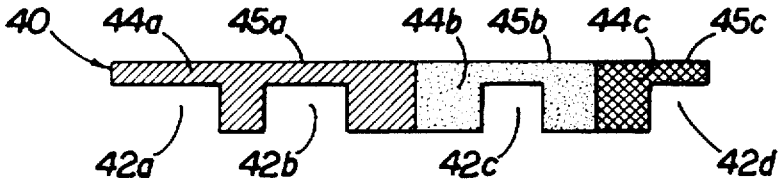
FIG. 2*a* is a diagram of a color coded alignment strip constructed according to the present invention.
Figure 2B:
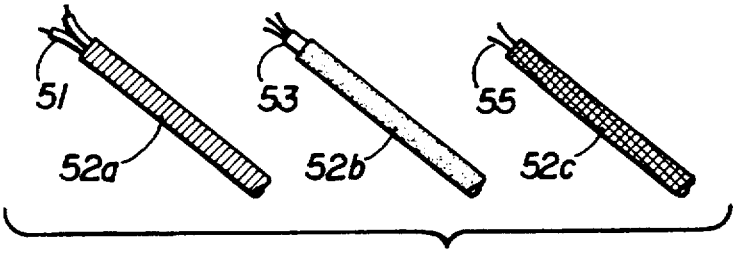
FIG. 2*b* shows color coded cables that correspond to the colors of the color coded alignment strip.
Figure 2C:
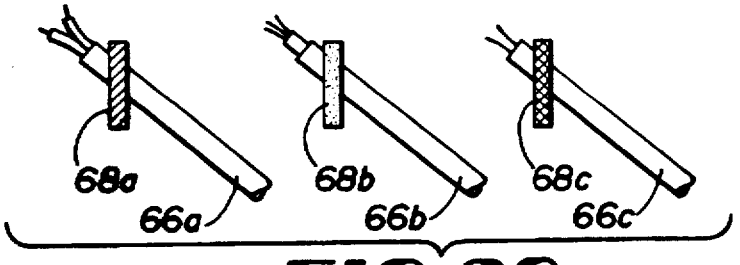
FIG. 2*c* shows an alternative embodiment of color coded cables that correspond to the colors of the alignment strip.

Referring to FIG. 2*c*, cables 66 are illustrated. The color of the insulation covering of cables 66*a*, 66*b* and 66*c* may be colors unrelated to the colors of the color coded alignment strip 40. However, the cables 66*a*, 66*b* and 66*c* are associated with the colors of a color coded alignment strip by color coded tags 68*a*, 68*b* and 68*c* attached to the connection cables 66. The color coded tags 68 thus color code the cables 66. These color coded cables 66 may then be associated with a connection port of the credit card terminal 12 by the corresponding color of the colored coded alignment strip 40 associated with the port.

Figure 2D:
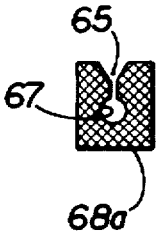
FIG. 2*d* is a front view of a color coded identification tag used with cables of FIG. 2*c*.

Referring to FIG. 2*d*, a front view of the color coded tag 68*a* is shown. The color coded tag 68 has a funnel opening 65 that leads to a cable fitting opening 67. The cable 66*a* fits in the cable fitting opening 67. The cable 66*a* may be placed in the opening 67 by placing the cable 66*a* in the funnel opening 65 then applying pressure on the cable 66*a* in the direction of the cable fitting opening 67. The funnel opening 65 then flexes open until the cable 66*a* is positioned in the cable fitting opening 67. The funnel opening 65 then returns to its original position and secures the color coded tag 68*a* on the cable 66*a*. It should be appreciated that the color coded tag 68*a* may be made of any material that has elastic properties suitable for flexing apart then closing or returning to its original position. Each of the color coded tags 68 may be constructed as described in connection with the color coded tag 68*a*.

Referring to FIG. 2*a*, the color coded alignment strip 40 has openings 42*a*, 42*b*, 42*c*, and 42*d*. The openings 42*a* and 42*b* correspond to the telephone jack connection ports 22*a* and 22*b* respectively when the color coded alignment strip 40 is placed on the credit card terminal 12. The opening 42*c* of section 45*b* of the color coded alignment strip 40 corresponds with the printer connection port 24 when the color coded alignment strip 40 is placed on the credit card terminal 12. The opening 42*d* of section 45*c* of the color coded alignment strip 40 corresponds with the power cord connection port 26 when the color coded alignment strip 40 is placed on the credit card terminal 12. When the color coded alignment strip 40 is placed on the credit card terminal 12, the colors located near or proximate to the connection port aids a user in determining which cable should be connected with the corresponding connection port.

Figure 3:
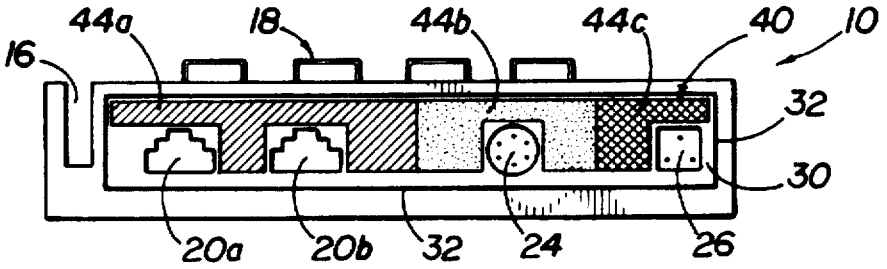
FIG. 3 is a diagram of the color coded alignment placed in the recess of the credit card terminal.

Referring to FIG. 3, the color coded alignment strip 40 is positioned in a recess 30 of the housing of the credit card terminal 12. The recess 30 extends around the electrical connection ports. The recess 30 of the credit card terminal 12 has a rim 32 defining the boundary of the recess. The color coded alignment strip 40 is placed in the recess 30 to associate each connection port with a color coded segment of the color coded alignment strip 40. The colors 44 of the color coded alignment strip 40 correspond to the colors of the cables that are to be connected into particular ports of the credit card terminal 12.

The color coded alignment strip 40 is shown placed in the recess 30 so that the color 44*a* is proximate to and corresponds with the telephone connection ports 20*a* and 20*b*. The color section 44*b* is proximate to and corresponds with the printer connection port 24 and the color 44*c* of the alignment strip 40 is proximate to and corresponds with the power cord connection port 26. The colors proximate and corresponding to the various connection ports indicate that the cable of the corresponding color should be placed or connected in the connection port proximate to the color of the alignment strip corresponding with the port.

Figure 4:
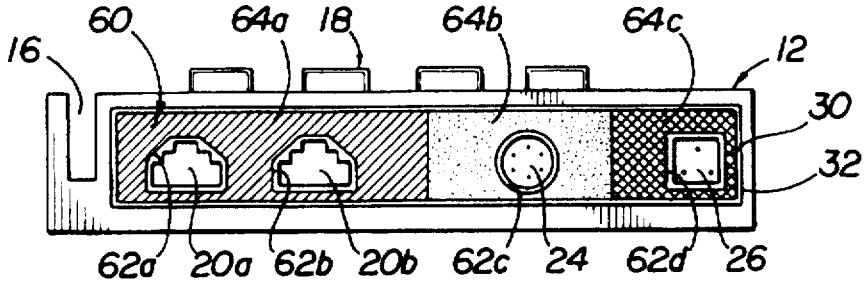
FIG. 4 is a diagram of an alternative embodiment of a color coded alignment strip placed in the recess of the credit card terminal.

Referring to FIG. 4, another embodiment of the present invention is illustrated. The embodiment of FIG. 4 also has a recess 30 with a rim 32. However, the embodiment of FIG. 4 utilizes a color coded alignment strip 60 that has openings 62*a*, 62*b*, 62*c*, and 62*d* defined in the color coded alignment strip 60. The color coded portions 64*a*, 64*b*, 64*c*, 64*d* entirely surround, or encompass the perimeter of the corresponding connection port 20*a*, 20*b*, 24 and 26, respectively. By entirely surrounding a connection port with a color coded section or item, a user may more readily identify the connection in which a connection cable should be inserted.

Figure 5A:
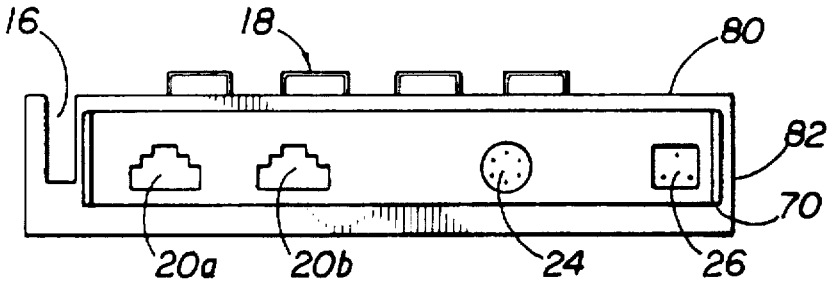
FIG. 5*a* is a diagram of a rim extending from a credit card terminal used for protecting a color coded alignment strip constructed according to the present invention.
Figure 5B:
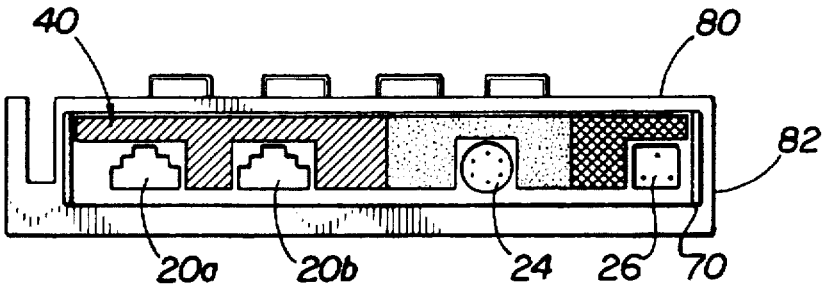
FIG. 5*b* is a diagram of the color coded alignment placed within the rim of the credit card terminal.
Figure 6:
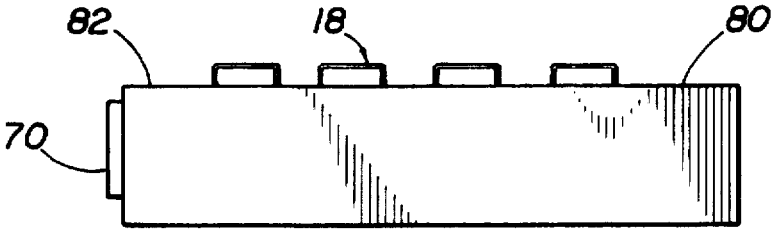
FIG. 6 is a side view of the credit card terminal of FIG. 5*a*.

Referring to FIGS. 5*a*, 5*b*, and 6 another embodiment of the present invention is shown. The embodiment of FIG. 5*a* is a credit card terminal 80 that has a raised rim 70 surrounding the connection ports for the credit card terminal 80. The rim 70 of the credit card terminal 80 extends from the housing 82 of the credit card terminal 80 a distance that is preferably equal to or greater than the thickness of the color coded alignment strip 40. FIG. 5*b* shows the color coded alignment strip 40 placed within the rim 70.

Referring to FIG. 6, a side view of the credit card terminal 80 is shown with the raised rim portion 70 illustrated. The rim 70 protects the edges of the color coded alignment strip 40 from inadvertent removal such as what would occur without the protection rim when a person or another device accidentally snags or pulls on the edge of a template. The distance that the rim 70 extends from the housing 82 may be termed the height of the rim 70. It should be appreciated that the height of the rim 70 may be less than the thickness of the color coded alignment strip. If the height of the rim 70 is less than the thickness of the alignment strip, the height should be chosen to be high enough to protect the edges of the color coded alignment strip 40 or template from being accidentally pulled away from the credit card terminal 12.

While the present invention has been illustrated in detail by the description of the preferred and alternative embodiments, additional advantages and modifications will readily appear to those skilled in the art. The invention's broader aspects are therefore not limited to the specific details presented. Accordingly, departures may be made from such details without departing from the spirit or scope of applicant's general inventive concepts.

The following is claimed:

1. A system for associating each of a plurality of individual electrical connection ports with a particular cable designated for connection with a specific one of said ports, comprising:

a device having a plurality of electrical connection ports for receiving color coded cables, said device having a recessed portion extending around said electrical connection ports, said recessed portion having a rim portion defining the boundary of said recessed portion, said rim portion having a height; and a color coded alignment strip having a thickness and a surface of colors arranged in ordered positions on said strip, said colors matching in color to color of said color coded cables, each color uniquely corresponding to one of the color coded cables, said color coded alignment strip being positioned and aligned in said recessed portion in a position that aligns said colors with said electrical connection ports that are to receive the color coded cables of the corresponding colors aligned with said electrical connection ports, and said color coded alignment strip fitting in said recessed portion and the thickness of the color coded alignment strip being flushed with or below the height of the rim portion extending above the surface of the device and wherein said colors aligned with said electrical connection ports extend around said electrical connection ports.

2. The system of claim 1 wherein said colors aligned with said electrical connection ports extend entirely around said electrical connection ports.

3. The system of claim 1 wherein said electrical connection ports are physically structured to receive only a specific type of cable.

4. The system of claim 1 wherein two of said electrical connection ports are uniquely identified by one color.

5. A system for associating each of a plurality of individual electrical connection ports with a particular cable designated for connection with a specific one of said ports, comprising:

a device having a surface and a plurality of electrical connection ports for receiving color coded cables, said device having a rim portion extending around said electrical connection ports; and a color coded alignment strip having a plurality of edges and a surface of colors arranged in ordered positions on said strip, said colors matching in color to color of said color coded cables;

said color coded alignment strip being positioned and aligned in said rim portion in a position that aligns said colors with said electrical connection ports that are to receive the color coded cables of the corresponding colors aligned with said electrical connection ports, and said color coded alignment strip fitting within said rim portion and said color coded alignment strip contacting said device within said rim portion, and wherein the height of the rim portion extending above the surface of the device is sufficiently high to protect the edges of said color coded alignment strip and wherein said colors aligned with said electrical connection ports extend around said electrical connection ports.

6. The system of claim 5 wherein said colors aligned with said electrical connection ports extend entirely around said electrical connection ports.

7. The system of claim 5 wherein said electrical connection ports are physically structured to receive only a specific type of cable.

8. A system for associating each of a plurality of individual electrical connection ports with a particular cable designated for connection with a specific one of said ports, comprising:

a device having a surface an a plurality of electrical connection ports for receiving color coded cables, said device having a rim portion extending around said electrical connection ports, said rim portion having an upper level extending away from a surface of said device, said rim portion having a height;

a plurality of color coded items each having a thickness, said color coded items matching in color to color of said color coded cables, said color coded items arranged in ordered positions and aligned in said rim portion in positions that align said color coded items with said electrical connection ports that are to receive the color coded cables of the corresponding color as said color coded items aligned with said electrical connection ports, said color coded items fitting in said rim portion and surfaces of said color coded items that are visible after said color coded items are positioned in said rim portion being flushed with or below the height of the rim portion extending above the surface of the device and wherein said color coded items aligned with said electrical connection ports extend around said electrical connection ports.

9. The system of claim 8 wherein said color coded items aligned with said electrical connection ports extend entirely around said electrical connection ports.

10. The system of claim 8 wherein said electrical connection ports are physically structured to receive only a specific type of cable.

* * * * *